US006454372B1

(12) United States Patent
Yang

(10) Patent No.: US 6,454,372 B1
(45) Date of Patent: Sep. 24, 2002

(54) POSITIONING DEVICE FOR A DRAWER RAIL

(76) Inventor: Jun-Long Yang, No. 33, Da-Hsin 15 St., Tai-Ping City, Taichung Hsien (TW)

( * ) Notice: Subject to any disclaimer, the term of this patent is extended or adjusted under 35 U.S.C. 154(b) by 5 days.

(21) Appl. No.: 09/714,044

(22) Filed: Nov. 16, 2000

(51) Int. Cl.[7] ..... A47B 88/00
(52) U.S. Cl. ..... 312/334.13; 312/334.45
(58) Field of Search ..... 312/334.46, 334.44, 312/334.45, 333, 334.11, 334.13, 334.8

(56) References Cited

U.S. PATENT DOCUMENTS 5,722,750 A * 3/1998 Chu ..... 312/334.11
5,757,109 A * 5/1998 Pavin ..... 312/334.46
6,145,945 A * 11/2000 Pavin ..... 312/334.46

* cited by examiner

*Primary Examiner*—Peter M. Cuomo
*Assistant Examiner*—Jerry A. Anderson
(74) *Attorney, Agent, or Firm*—William E. Pelton, Esq.

(57) ABSTRACT

A drawer rail includes an outer rail fixed to a furniture item, a sliding rail slidably contained in the outer rail, a ball rail slidably contained in the sliding rail, and an inner rail slidably contained in the outer rail and fixed to the drawer or a keyboard supporter. The sliding rail has a front end extending towards an outermost side of the drawer by which it is pulled outward. A positioning device is fixed on the sliding rail near the front end of the sliding rail. The positioning device has a body and a head having a pair of side slopes that are able to respectively engage with a pair of side walls of a groove defined in a bottom of the ball rail. The positioning device of the invention is able to provide a stable positioning effect for the inner rail, and thus the drawer, when the drawer is pulled to an outermost position.

1 Claim, 10 Drawing Sheets

POSITIONING DEVICE FOR A DRAWER RAIL

BACKGROUND OF THE INVENTION

1. Field of the Invention

The invention relates to a positioning device for a drawer rail, especially to a positioning device that is simple but able to provide a secure positioning effect.

2. Description of Related Art

At present, most drawers and keyboard supporters in desks and other furniture use rails to support the drawers and keyboard supporter and allow them to be slidable with respect to the furniture item. As shown in FIGS. 7 to 10, a conventional drawer rail has an outer rail (70) fixed to the furniture item (not shown), a sliding rail (73) contained in the outer rail (70), a ball rail (80) contained in the sliding rail (73), and an inner rail (95) fixed to the drawer or the keyboard supporter (not shown). The outer rail (70) has a bottom that is fixed to the furniture item, and a pair of side plates extend upward from the bottom. A plurality of seats (71) are formed on each side plate and each contains a steel outer ball (72). The sliding rail (73) also has a bottom and a pair of side plates extend upward from the bottom. As especially shown in FIG. 9, in the cross sectional view of the sliding rail (73), the bottom has a convex portion (74) and each side plate is substantially S-shaped having an inner groove (75) and an outer groove. The outer balls (72) are rotatably contained in the outer groove to allow the slide rail (73) to be slidable with respect to the outer rail (70). The ball rail (80) also has a bottom and a pair of side plates (81). The bottom has a convex portion (83) corresponding to the convex portion (74) formed in the sliding rail (73). A plurality of steel inner balls (82) are rotatably contained in a plurality of corresponding openings defined in the pair of side plates (81) of the ball rail (80). The inner balls (82) are rotatably contained in the inner groove (75) in the sliding rail (73) to allow the ball rail (80) to be slidable with respect to the sliding rail (73). When the inner balls (82) roll along the inner groove (75), a lower surface of the convex portion (83) is at a certain distance apart from an upper surface of the convex portion (74) of the sliding rail (73). The inner rail (95) has a bottom that is fixed to a drawer and a pair of side plates extend downward from the bottom. The side plates are arcuate to define a groove in which the inner balls (82) can be rotatably contained. The sliding rail (73) has an opening defined therein at an outermost end thereof A positioning device in a form of a rubber pad (90) is inserted in the opening and securely fixed there. The rubber pad (90) has an upper slope (91). When a user pulls the drawer outwardly, the inner rail (95) moves outwardly accordingly. Then the inner balls (82) roll and go outwardly along the inner groove (75) of the sliding rail (73) by frictional contact with the inner rail (95). The inner balls (82) push the ball rail (80) outwardly until a front end (A) of the ball rail (80) meets the slope (91) of the rubber pad (90) and is stopped by a certain friction between the slope (91) and the front end (A). With this friction, the inner rail (95), and thus the drawer or the keyboard supporter, can be positioned with a certain degree of stability. When a user pushes the drawer inwardly, the inner rail (95) moves inwardly. The friction between the inner rail (95) and the inner balls (82) will roll the inner balls (82) to go inwardly along the inner groove (75) of the sliding rail (73). The inner balls (82) push the ball rail (80) inwardly to leave the rubber pad (90).

However, the positioning device of the conventional drawer rail has its drawbacks. When the front end (A) of the ball rail (80) goes outward along the slope (91), it will go upward simultaneously. That means a close requirement in the tolerance must be met between the inner balls (82) and the inner groove (75) of the sliding rail (73) because if the inner balls are over large or the inner groove (75) is over small, the front end (A) of the ball rail (80) can not move upward and downward in a great range which will cause the front end (A) to not be able to go along the slope (19) a distance necessary to provide a sufficient friction. On the other hand, if the inner balls are too small or the inner groove is too large, the front end (A) will be able to move upward and downward in a great range, which will cause the front end (A) to not be able to contact the slope (91) intimately.

SUMMARY OF THE INVENTION

The main object of the invention is to provide a positioning device for drawer rail that does not require a close tolerance between the inner balls and the inner groove but is still able to provide a secure positioning effect for the rail.

Other objects, advantages and novel features of the invention will become more apparent from the following detailed description when taken in conjunction with the accompanying drawings.

DETAILED DESCRIPTION OF THE PREFERRED EMBODIMENT

Figure 1:
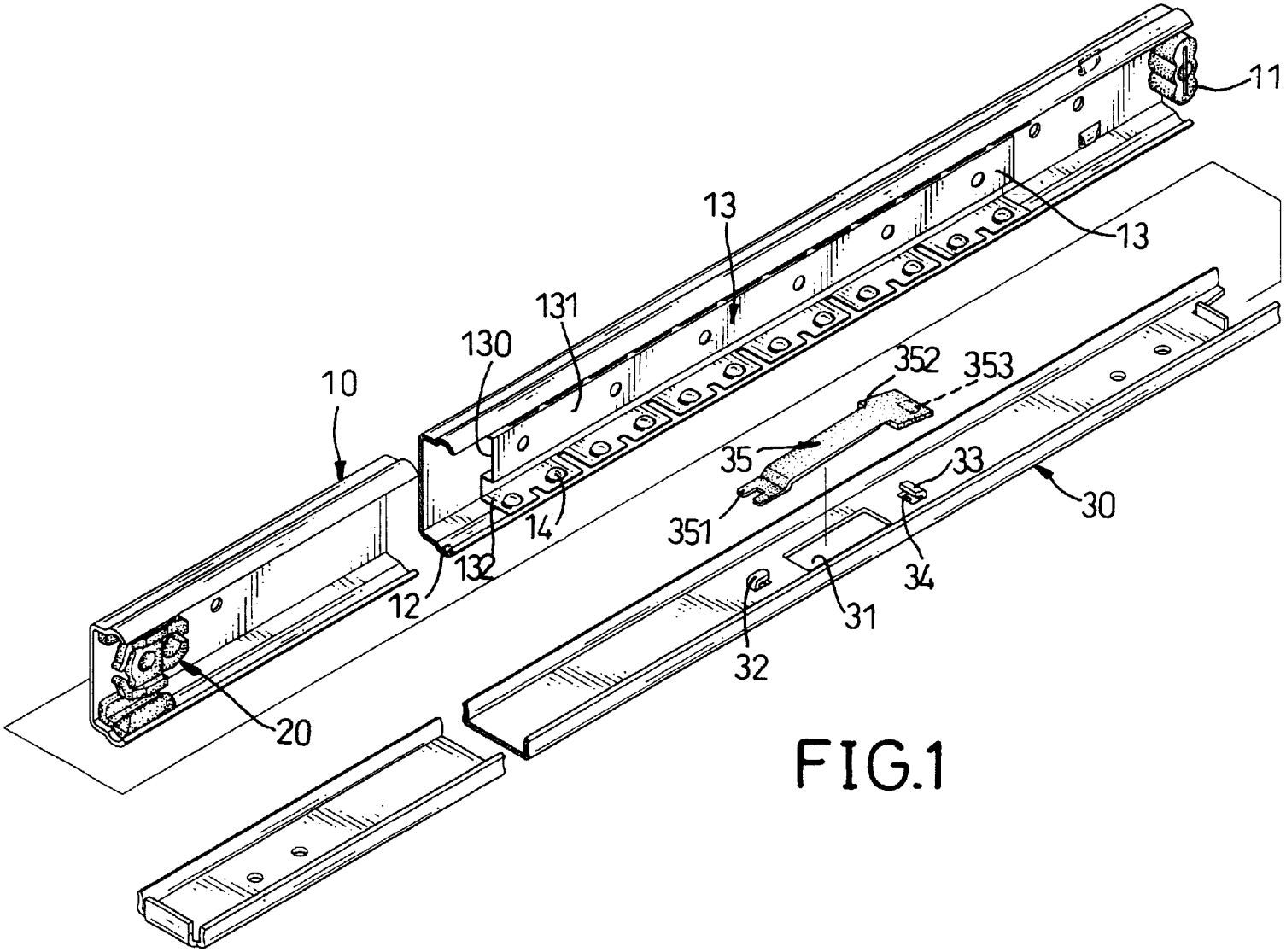
FIG. 1 is an exploded perspective view of the invention.

A drawer rail shown in FIG. 1 has an outer rail (not shown) fixed to a body of furniture, a sliding rail (10) contained in the outer rail, a ball rail (13) contained in the sliding rail (10), and an inner rail (30) fixed to a drawer or a keyboard supporter (not shown). The sliding rail (10) has a bottom and a pair of side plates extend upward from the bottom. Each side plate is substantially S-shaped having an inner groove (12) and an outer groove. The ball rail (13) also has a bottom and a pair of side plates (132). The bottom has a convex portion (131) defining a groove (130) thereunder. As especially shown in FIG. 6, the groove (130), which defines a space between bottom of ball rail and bottom of the sliding rail, has two opposite side walls that are substantially vertical to the bottom of the ball rail (13). A plurality of steel balls (14) are rotatably contained in a plurality of corresponding openings defined in the pair of side plates (132) of the ball rail (13). The balls (14) are rotatably contained in the inner groove (12) in the sliding rail (10) to allow the ball rail (13) to be slidable with respect to the sliding rail (10). The inner rail (30) has a bottom that is fixed to a drawer and a pair of side plates extend downward from the bottom. The side plates are arcuate to define a pair of inner rail grooves in which the balls (14) can be rotatably contained. The inner rail (30) can be inserted into the sliding rail (10) with the balls (14) being rotatably contained in the inner groove (12) of the sliding rail (10) and the corresponding inner rail groove, and thus the inner rail (30) being slidable with respect to the sliding rail (10). The sliding rail has a front end which extends towards an outermost side of the drawer which is pulled out. An opposite end to the front end of the sliding rail (10) is a rear end. Two ends of the inner rail (30) corresponding to the front end and rear end of the sliding rail (10) are a first end and a second end, respectively. A stop (11) is formed on the sliding rail (10) at the rear end of the sliding rail (10). When the drawer is pushed inward, the second end of the inner rail (30) will finally meet the stop (11) and stop there.

Figure 2:
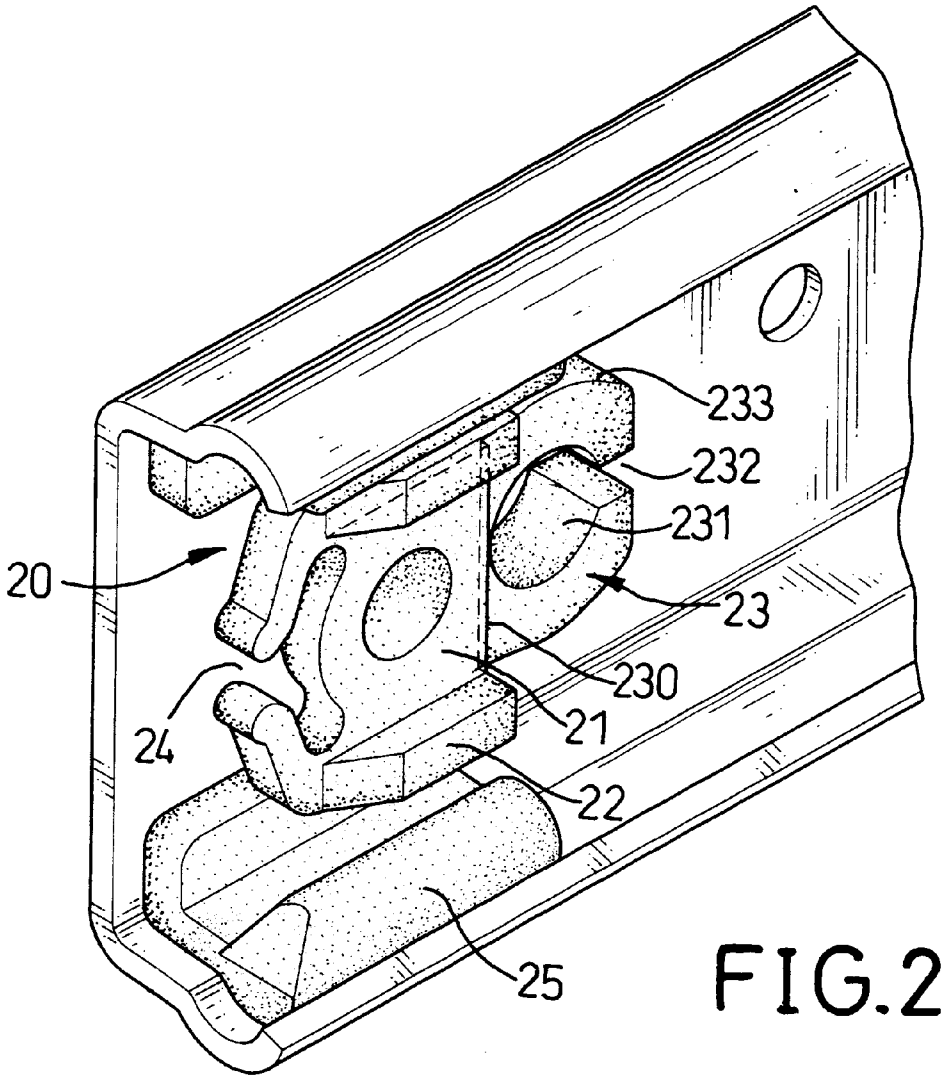
FIG. 2 is a perspective view showing the positioning device of the invention.

A positioning device (20) is attached on the bottom of the sliding rail (10) between the pair of side plates. As shown in FIG. 2, the positioning device (20) includes a body (21), a head (23) formed on the body (21) and extending to the rear end of the sliding rail (10), a pair of protrusions (22) formed on the body (21), and a rear slit (24) defined in the body (21) and at an end opposite the head (23). In the embodiment shown in FIG. 2, the head (23) is a C-shaped ring having a pair of arms (233) enclosing an opening (231) and leaving a gap (232) therebetween. The arms (233) each have a sloping face facing outward. In other embodiments, the head (23) can be a complete ring without the gap (232) or a solid body without the opening (231). A height of the head (23) is a certain amount smaller than that of the body (21) thus defining a stage (230) the height of which is substantially the same as a thickness of the ball rail (13). An ushering bar (25) is attached in each inner groove (12). As especially shown in FIG. 5, a top of the ushering bar (25) is substantially as high as tops of the balls (14).

Figure 6:
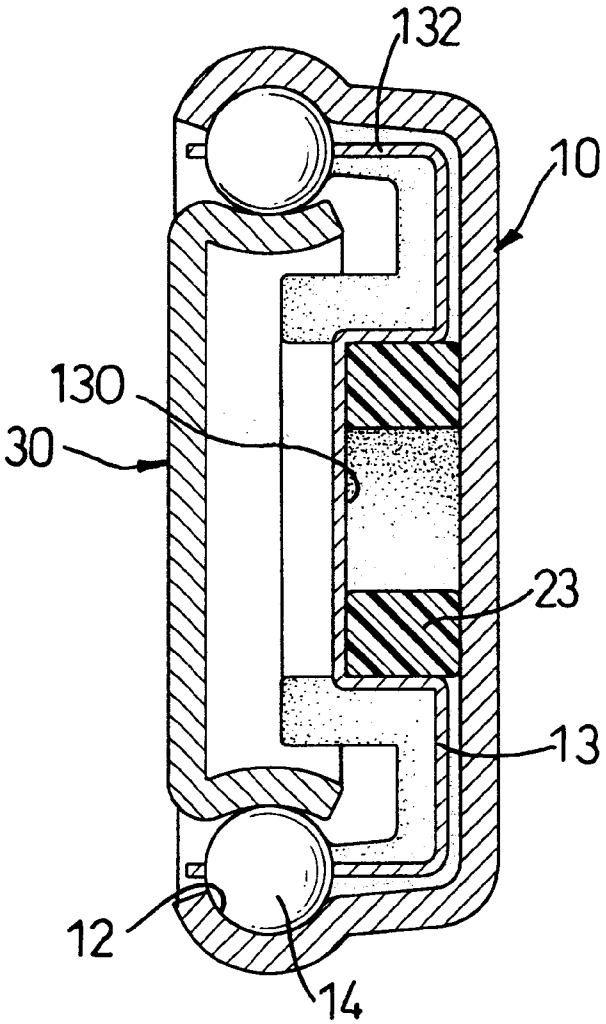
FIG. 6 is yet another cross sectional partial view along line 6—6 of FIG. 4 showing a status after the ball rail engages with the positioning device.
Figure 7:
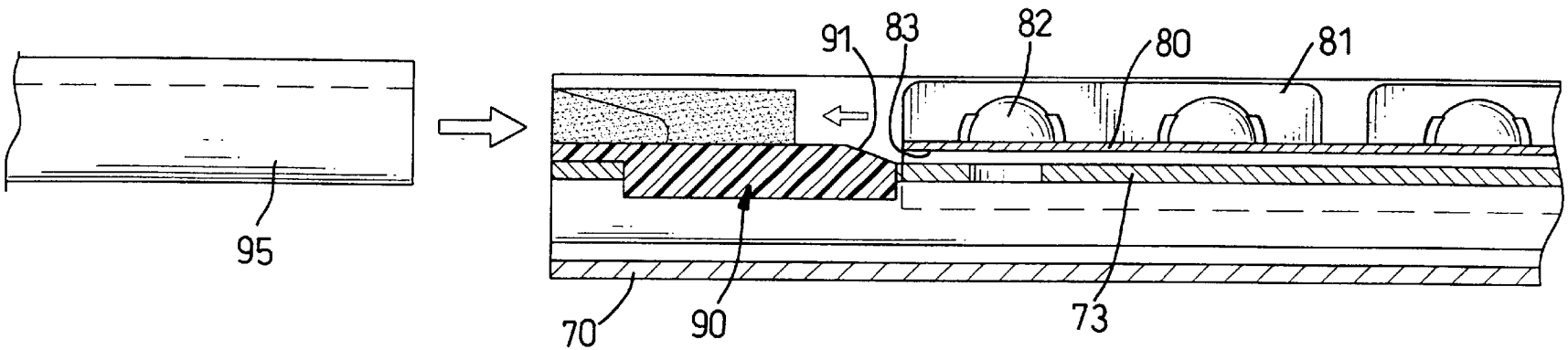
FIG.7 PRIOR ART
FIG. 7 is a cross sectional view of a conventional rail showing a status before the ball rail engages with the positioning device.
Figure 8:
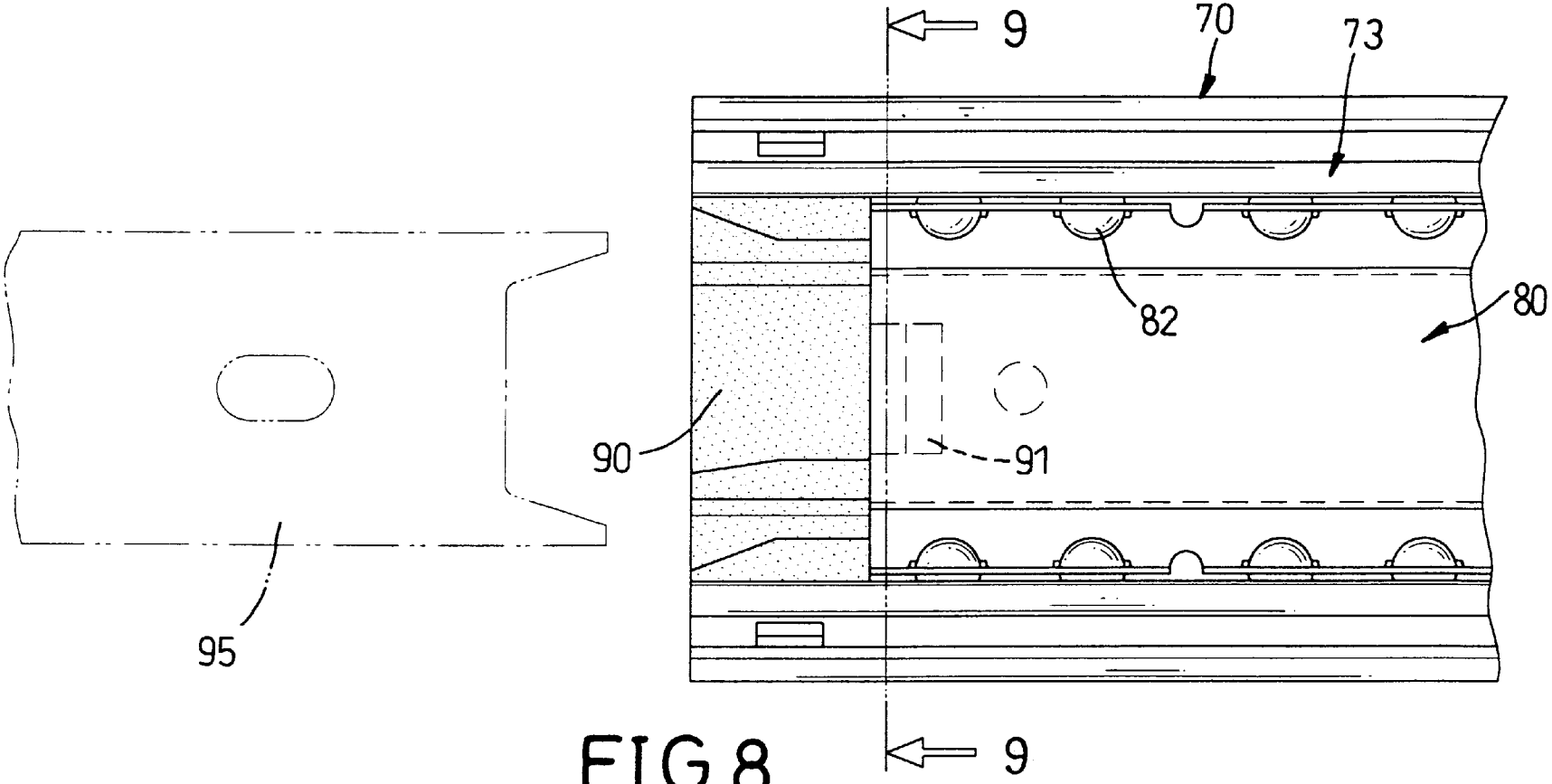
FIG.8 PRIOR ART
FIG. 8 is a top plan view of the conventional rail shown in FIG. 7 showing a status after the ball engages with the positioning device.
Figure 9:
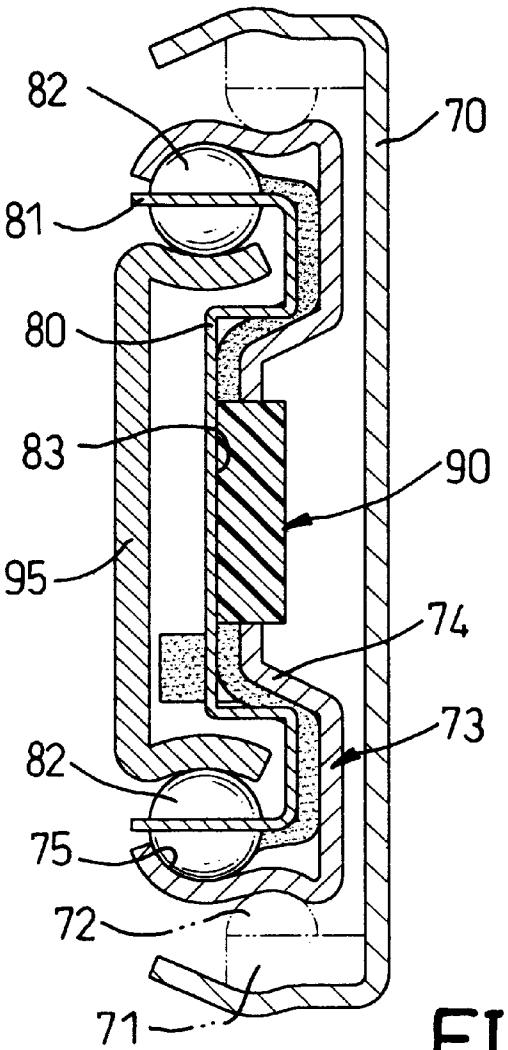
FIG.9 PRIOR ART
FIG. 9 is a cross sectional view taken along line 9—9 in FIG. 8; and, FIG. 10 is a cross sectional view of the conventional rail shown in FIG. 7 showing a status after the ball rail engages with the positioning device.
Figure 10:
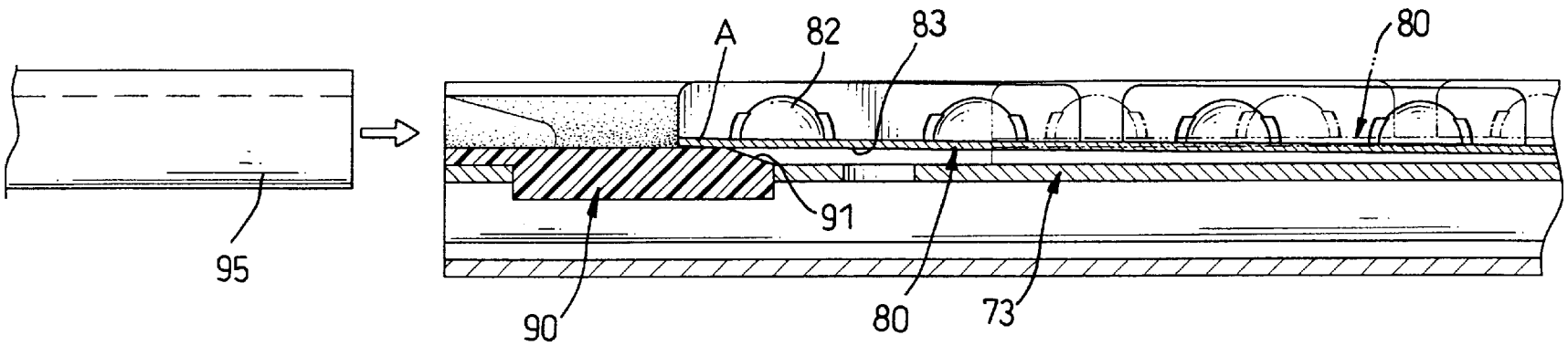
FIG.10 PRIOR ART

FIG. 6 is a cross sectional view showing the configuration of the drawer rail of the invention.

Figure 3:
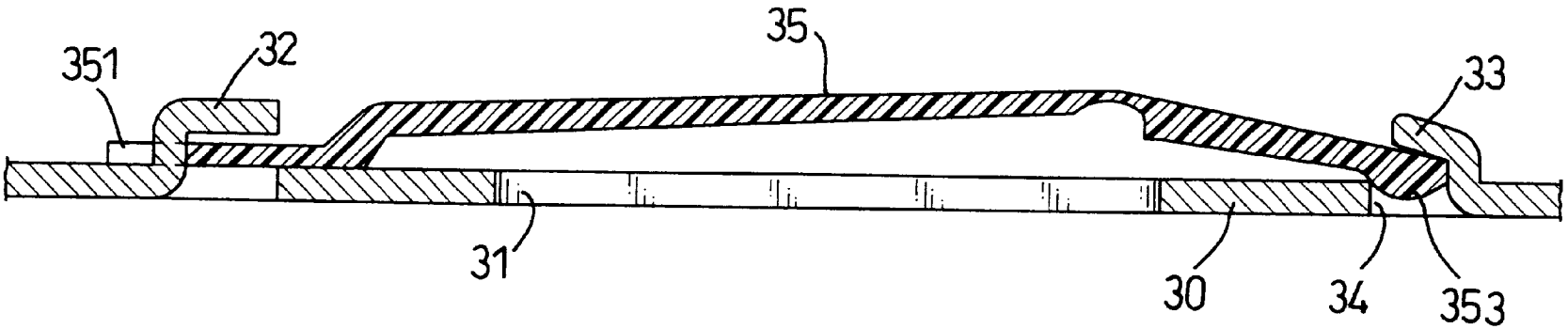
FIG. 3 is a cross sectional view showing the locking means of the invention.

With reference to FIGS. 1 and 3, a locking means is provided in the inner rail (30). The locking means includes an opening (31) defined in the bottom of the inner rail (30). A first and a second small protrusion (32, 33) are formed on the bottom of the inner rail (30) near the opening (31) respectively in a direction of the first and the second ends of the inner rail (30). A small opening (34) is defined under the second protrusion (33). An elastic arched plate (35) is provided having a front fork (351) and a rear head. The rear head can be substantially a square having a pair of shoulders (352) and a bottom nose (353). In assembly, the front fork (351) can engage with the first small protrusion (32) and the bottom nose (353) is put in the small opening (34). When a user pulls the drawer outward, the locking means moves together with the inner rail (30) and the shoulders (352) thereof will finally meet the pair of protrusions (22) and be stopped there. At this time, if a user wants to release the drawer from the furniture, the user can push the arched plate (35) towards the inner rail (30) until the shoulders (352) move downward and leave the protrusions (22). Then the drawer can be pulled out from the sliding rail (10), and thus out from the furniture item.

Figure 4:
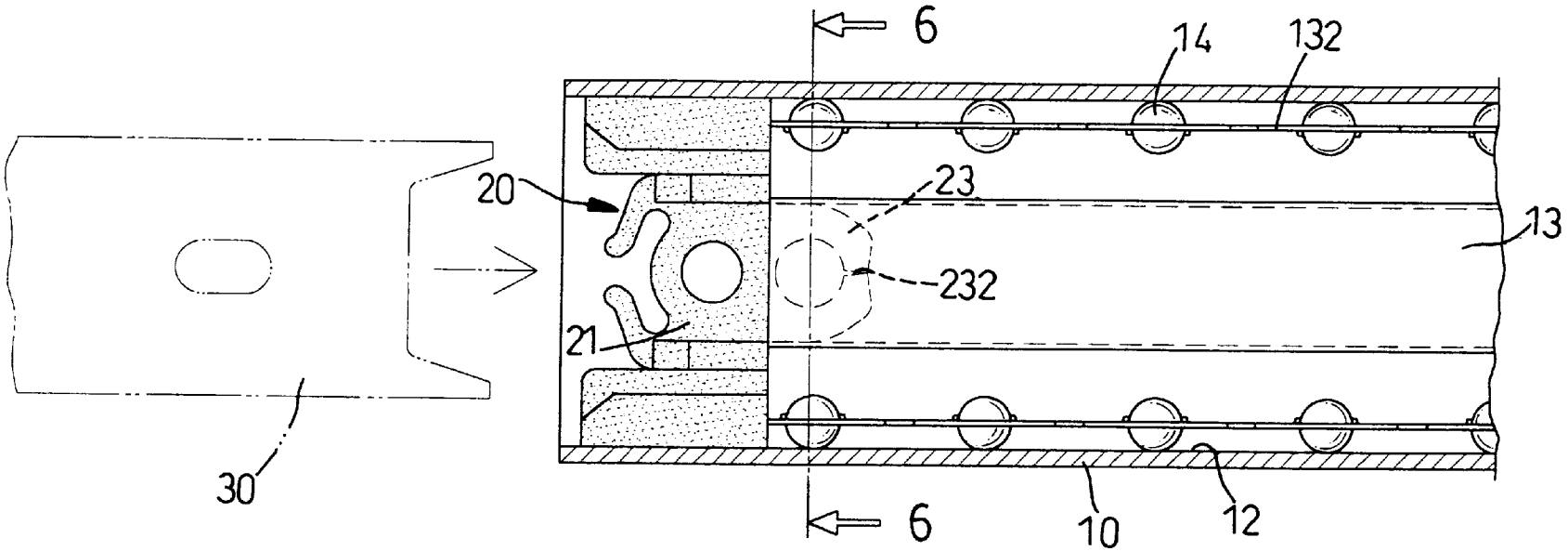
FIG. 4 is a cross sectional partial view of the invention.

As shown in FIG. 4, when a user pulls the drawer outward, a frictional contact between the inner rail (30) and the balls (14) will roll and move the balls (14) outward. The balls (14) will push the ball rail (13) outward towards the positioning device (20) until a front end of the ball rail (13) meets the head (23) of the positioning device (20).

Figure 5:
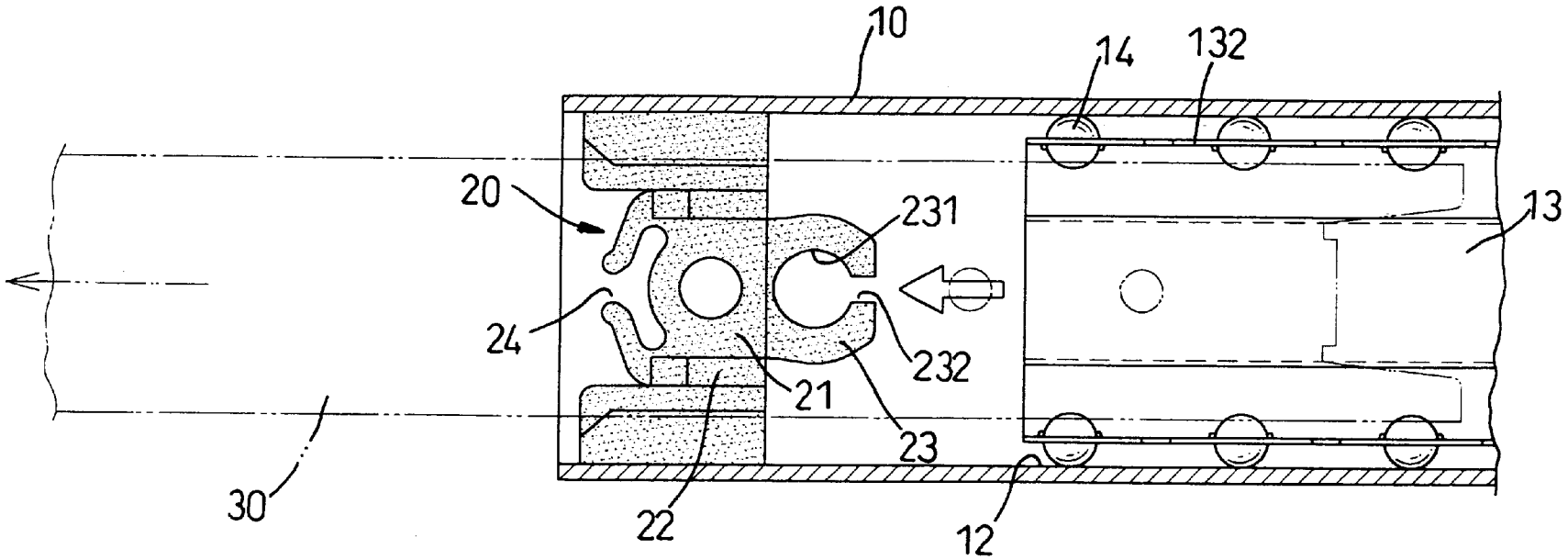
FIG. 5 is another cross sectional partial view of the invention showing a status before the ball rail engages with the positioning device.

As shown in FIG. 5, the drawer is pulled further and the two opposite side walls of the groove (130) will first meet the slopes of the arm (233), respectively. When the inner rail (30), and thus the ball rail (13), continues to move outward, the two side walls will move outward along the slopes and simultaneously push the arms (233) towards each other. Finally a front edge of the ball rail (13) will meet the stage (230) and be stopped there. At this time, the ball rail (13) is fixed with respect to the sliding rail (10) with certain stability under a frictional contact between the side walls of the groove (130) and the slopes of the arms (233). Because the balls (14) can not roll along the inner groove (12) at this time, the inner rail (30) is therefore fixed with respect to the ball rail (13) with a certain stability under a frictional contact therebetween. Thus, the drawer or the keyboard supporter is positioned with respect to the furniture item with certain stability when it is pulled out. When the drawer or the keyboard needs to be pushed back, a user can push it with a certain force. Then the inner rail (30) will roll and move the balls (14) inwardly. The balls (14) then push the ball rail (13) to overcome the friction between the side walls and slopes to leave the head (23) of the positioning device (20). The rear slit (24) is used to enhance ability in deformation of the positioning device (20).

From above description, it is to be understood that the positioning device (20) of the invention is able to fix the ball rail (13) with a pair of side slopes thereof. Therefore, the requirement in the tolerance between the balls (14) and the inner grooves (12) is not so close as that of the conventional drawer rail.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A positioning device in a drawer rail adapted to be fixed to a furniture item, a sliding rail slidably contained in the outer rail, a ball rail slidably contained in the sliding rail, and an inner rail adapted to be fixed to a drawer and slidably contained in the sliding rail, the sliding rail having a bottom and a pair of side plates, the ball rail having a bottom and a pair of side plates in each of which a row of a plurality of openings are defined to contain a plurality of corresponding balls, each side plate of the sliding rail having an inner groove along which the two rows of balls can move respectively, the sliding rail having a front end extending towards an outermost side of the drawer by which the drawer is pulled outward, an opposite end to the front end of the sliding rail being a rear end, a convex portion being formed in the bottom of the ball rail thus defining a groove having a pair of opposite side walls, the positioning device comprising:

a body attachable on the bottom of the sliding rail and near the front end of the sliding rail and configured to abut an end face of the ball rail;

a head formed on the body and extending toward the rear end of the sliding rail, the head having two arms enclosing a central opening and defining a gap therebetween, the two arms each being arcuate and facing each other so as to form a C shape to be snugly receivable in the ball rail, whereby the two arms are deformable by the two side walls of the convex portion of the ball rail so as to selectively retain the ball rail; and a pair of protrusions formed on the body, the protrusions abutting the bottom of the ball rail when the ball rail is pulled outward and limiting travel of the ball rail.

* * * * *